United States Patent [19]

Harada et al.

[11] 4,233,511

[45] Nov. 11, 1980

[54] SCOROTRON CHARGING APPARATUS

[75] Inventors: Masahide Harada; Manabu Mochizuki, both of Tokyo, Japan

[73] Assignee: Ricoh Company, Ltd., Tokyo, Japan

[21] Appl. No.: 21,900

[22] Filed: Mar. 19, 1979

[30] Foreign Application Priority Data

Mar. 24, 1978 [JP] Japan ..... 53-32972

[51] Int. Cl.[3] ..... H01T 19/04

[52] U.S. Cl. ..... 250/325; 250/324

[58] Field of Search ..... 250/325, 324

[56] References Cited

U.S. PATENT DOCUMENTS 3,160,746 12/1964 Clark ..... 250/325

*Primary Examiner*—Harold A. Dixon

*Attorney, Agent, or Firm*—David G. Alexander

[57] ABSTRACT

A plurality of parallel wires (27) are disposed between a corona discharge electrode (24) and a surface (13) to be electrostatically charged. The surface (13) is moved relative to the electrode (24) and wires (27). The wires (27) are equally spaced from each other in a plane (28) which is inclined relative to the surface (13) in such a manner that the spacing between the wires (27) and the surface (13) increases in the direction of movement of the surface (13) relative to the wires (27). A high voltage for corona discharge is applied to the electrode (24). A low voltage is applied to the wires (27) to prevent the surface (13) from being charged above a predetermined potential. The low voltage may be applied to the wires (27) by means of a zener diode (31) connected between the wires (27) and ground which prevents a potential induced in the wires (27) from the electrode (24) from exceeding the zener voltage of the diode (31).

7 Claims, 9 Drawing Figures

SCOROTRON CHARGING APPARATUS

BACKGROUND OF THE INVENTION

The present invention relates to a scorotron charging apparatus for an electrostatic copying machine or the like.

In an electrostatic copying machine a photoconductive drum or the like is electrostatically charged by a corona charging unit and radiated with a light image of an original document to form an electrostatic image through localized photoconduction. Toner is applied to the drum to develop the electrostatic image into a toner image which is transferred and fixed to a copy sheet to provide a permanent reproduction of the original document.

It is desirable to ensure that the initial electrostatic charge applied to the drum has a predetermined value under various conditions of temperature, etc., and it is especially necessary to prevent the drum from becoming overcharged. If the charge has too high or low a potential, the density of the copy will be too high or too low respectively. If the charge potential exceeds the breakdown voltage of the photoconductive coating on the drum, the photoconductive coating will become permanently damaged.

To provide this function, corona chargers known in the art as "scorotron" chargers have been developed. Typical examples of such chargers are disclosed in U.S. Pat. Nos. 2,777,957 and 2,778,946 and comprise a corona charging electrode. A plurality of wires are disposed between the electrode and the surface to be charged. A high voltage is applied to the electrode. A low voltage which is slightly lower than the desired predetermined potential to be formed on the drum is applied to the wires. The wires prevent the drum surface potential from exceeding a certain value.

When the charge on the drum surface is below the potential on the wires, ion current from the electrode flows to both the wires and the drum surface. The ion current flow to the drum surface increases the electrostatic potential thereon, or in other words charges the surface. However, as the surface potential somewhat exceeds the potential on the wires, a reverse electric field is produced between the surface and the wires which repels the ions back toward the electrode. When the surface potential is sufficiently greater than the potential on the wires, an equilibrium condition will be created in which there is no further ion current from the electrode to the surface. In this case, all ion current flow will be from the electrode to the wires.

In actual practice, however, it has been discovered that ion current to the surface does not completely cease even when the predetermined potential is reached, and a certain amount of leakage current enables further charging of the surface. A prior art expedient has been proposed to reduce this leakage current to a negligible value. The expedient consists of decreasing the spacing between the wires in the direction of movement of the surface. Thus, at the downstream end, the spacing between the wires is smaller than at the upstream end. This has the effect of progressively choking off the ion current to the surface and reducing it near zero at the downstream end of the charging apparatus.

Although this method is reasonably effective in eliminating the leakage current, it has been determined in actual practice that the spacing between the wires must be reduced to such an extent that the width of the electrode and the power supply thereto must be increased to a disproportionate extent to overcome the increased shielding effect of the wires and allow the surface to be charged to the required potential. These conflicting requirements dictate that the charging apparatus must be overly large in size for practical application and be supplied with an excessive voltage which is detrimental to economy and safety.

SUMMARY OF THE INVENTION

A corona charging apparatus of the scorotron type embodying the present invention comprises a corona discharge electrode and a plurality of wires disposed between the electrode and a surface which is moved relative to the electrode and wires. The spacing between the wires and the surface progressively increases in the direction of movement of the surface relative to the electrode.

In accordance with the present invention, a plurality of parallel wires are disposed between a corona discharge electrode and a surface to be electrostatically charged. The surface is moved relative to the electrode and wires. The wires are equally spaced from each other in a plane which is inclined relative to the surface in such a manner that the spacing between the wires and the surface increases in the direction of movement of the surface relative to the wires. A high voltage for corona discharge is applied to the electrode. A low voltage is applied to the wires to prevent the surface from being charged above a predetermined potential. The low voltage may be applied to the wires by means of a zener diode connected between the wires and ground which prevents a potential induced in the wires from the electrode from exceeding the zener voltage of the diode.

It is an object of the present invention to provide a scorotron charging apparatus for an electrostatic copying machine which overcomes the drawbacks of the prior art and positively limits an electrostatic potential applied thereby to a surface to a predetermined value.

It is another object of the present invention to provide a scorotron charging apparatus which is reasonably small in size and requires a relatively small amount of electrical power for efficient operation compared to the prior art.

It is another object of the present invention to provide a generally improved scorotron charging apparatus for an electrostatic copying machine or the like.

Other objects, together with the foregoing, are attained in the embodiments described in the following description and illustrated in the accompanying drawing.

DESCRIPTION OF THE PREFERRED EMBODIMENTS

While the scorotron charging apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
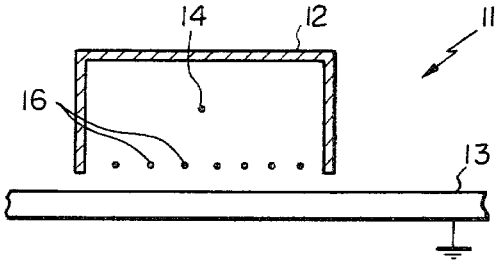
Fig. 1 PRIOR ART
FIG. 1 is a simplified diagram of a prior art scorotron charger.

Referring now to FIG. 1 of the drawing, a prior art scorotron charging apparatus is generally designated by the reference numeral 11 and comprises an electrically conductive housing 12 which constitutes a shield. The housing 12 is formed with an open end facing a surface 13 which is to be electrostatically charged. The surface 13 is typically constituted by a photoconductive drum or belt of an electrostatic copying machine. Such a drum or belt comprises a grounded, electrically conductive core on which is formed a photoconductive coating or layer. The photoconductive layer faces the apparatus 11 and acts as an insulator in the absence of light. The apparatus 11 is arranged to electrostatically charge the surface 13 in the dark as the first step of an electrostatic copying process.

A corona charging electrode 14 is disposed in the housing 12 and extends perpendicular to the plane of the drawing. The surface 13 is moved rightwardly relative to the apparatus 11 which is held stationary. It will be understood, however, that equivalent results may be obtained by holding the surface 13 stationary and moving the apparatus 11 leftwardly relative thereto, and that such a modification is within the scope of the present invention.

The prior art apparatus 11 further comprises a plurality of wires 16 which are parallel to and equally spaced from each other. The wires 16 extend parallel to the electrode 14 or perpendicular to the plane of the drawing. It will be further noted that, in accordance with the prior art, the spacing between the wires 16 and the surface 13 is constant. In other words, the wires 16 lie in a plane which is parallel to the surface 13.

Although not illustrated, a high voltage power source applies a positive or negative voltage to the electrode 14 sufficient to cause corona discharge and the production of an ion current from the electrode 14 to the surface 13. The applied voltage is high enough to charge the surface 13 to a predetermined potential in a length of time which depends on the speed of movement of the surface 13 and other geometrical factors. The power source also applies a low voltage to the wires 16 of the same polarity as the voltage applied to the electrode 14. However, the voltage applied to the wires 16 is lower than that applied to the electrode 14. The value of the voltage applied to the wires 16 is slightly lower than the desired predetermined surface potential to which the surface 13 is to charged by the apparatus 11.

As described hereinabove, when the potential of the surface 13 exceeds the potential on the wires 16 to a sufficient extent, a reverse potential will be developed between the surface 13 and wires 16 which prevents further ion current to the surface 13 and thereby prevents the surface potential from further increasing. Under such conditions, all ion current flows from the electrode 14 to the wires 16. However, the prior art apparatus 11 suffers from the drawback discussd hereinabove in that not all ion current flow is blocked by the wires 16 when the surface potential reaches the predetermined value and there is a danger of overcharging the surface 13.

Figure 2:
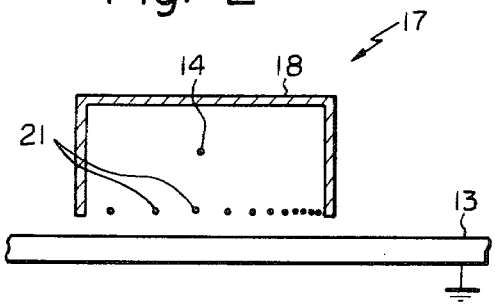
Fig. 2 PRIOR ART
FIG. 2 is a simplified diagram of another prior art scorotron charger.

FIG. 2 illustrates a modified prior art scorotron charging apparatus for charging the surface 13 which comprises a housing 18 and electrode 19 which generally correspond to the housing 12 and electrode 14 respectively. The apparatus 17 further comprises a plurality of wires 21 which disposed parallel to each other and perpendicular to the plane of the drawing. The wires 21 are all spaced from the surface 13 by the same distance. However, the spacing between the wires 21 is decreased in the direction of movement of the surface 13 relative to the apparatus 17, or in the rightward direction. The reduced spacing between the wires 21 progressively increases the shielding effect and reduces the leakage current. However, the major dimension of the electrode 19 must be overly large and the applied power excessive in order to charge the surface 13 to the desired potential.

Figure 3:
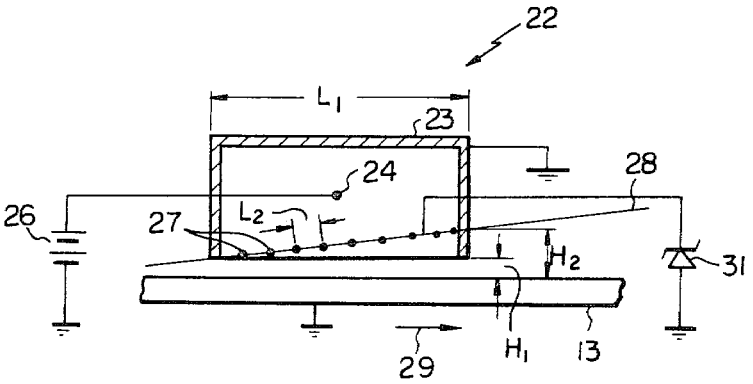
FIG. 3 is a simplified diagram of a first embodiment of a scorotron charger embodying the present invention.

These drawbacks are overcome by a scorotron charging apparatus embodying the present invention which is illustrated in FIG. 3 and generally designated as 22. The apparatus 22 comprises a conductive housing 23 which is electrically grounded and constitutes a shield. A corona charging electrode 24 is disposed inside the housing 23 and extends perpendicular to the plane of the drawing. A high positive voltage sufficient to cause corona discharge and charge the surface 13 is applied to the electrode 24 from the high voltage end of a D.C. power source 26. The low voltage or negative end of the power source 26 is grounded.

In accordance with an important feature of the present invention, the apparatus 22 further comprises a plurality of wires 27 which are parallel to each other and extend perpendicular to the plane of the drawing. The spacing between adjacent wires 27 in a plane 28 which is inclined relative to the surface 13 is constant and has a value L2. However, due to the inclination of the plane 28, the spacing between the wires 27 and the surface 13 progressively increases in the direction of movement of the surface 13 relative to the apparatus 22. In this case, the surface 13 is moved rightwardly as indicated by an arrow 29. Thus, the spacing between the wires 27 and the surface 13 is maximum at the downstream (rightward) end of the apparatus 22 and minimum at the upstream (leftward) end of the apparatus 22.

Figure 5:
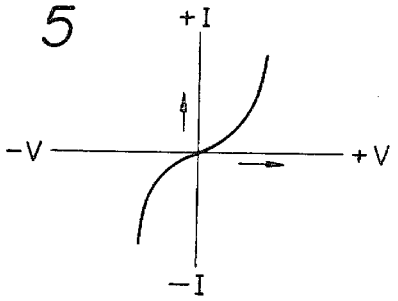
FIG. 5 is a graph illustrating the electrical characteristics of a zener diode used in the present apparatus.

The wires 27 are electrically connected together and are further connected to the cathode of a zener diode 31. The anode of the zener diode 31 is connected to the low voltage end of the power source 26, which in this case is ground. The corona electrode 24 induces a potential in the wires 27 during operation of the apparatus 22. The zener diode 31 limits the induced voltage to the zener voltage of the diode 31. Thus, the zener diode 31 provides a low voltage power supply to the wires 27 without the necessity of a separate power source. The voltage verses current characteristics of the zener diode 31 are illustrated in FIG. 5. The zener voltage of the diode 31 is selected so that the potential on the surface 13 will be limited to the desired predetermined value, and may be determined empirically.

Figure 6:
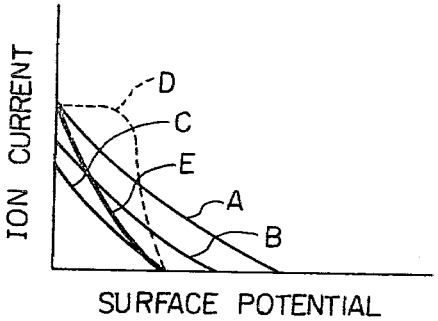
FIG. 6 is a graph illustrating the principle of the present invention.

FIG. 6 illustrates the principle of the present invention. Curves A, B and C indicate the ion current to the surface 13 as a function of the potential on the surface 13. The curve A relates to the prior art apparatus 11 in which the spacing between the wires 16 and the surface 13 is constant and the spacing between the adjacent wires 16 is also constant. The spacing between the wires 16 and the surface 13 is assumed to have a certain value.

The curve B illustrates a case in which the spacing between the wires 16 and surface 13 is increased over the value for the curve A, with all other factors being unchanged. It will be seen that the ion current decreases to zero at a certain value of surface potential. However, the initial ion current (at zero surface potential) and the final surface potential (at zero ion current) are lower for the curve B than for the curve A. A curve C illustrates the case in which the spacing between the wires 16 and surface 13 is yet further increased. It will thus be seen that the shielding effect of the wires 16 increases as the spacing between the wires 16 and surface 13 increases.

This principle is used to advantage in accordance with the present invention as indicated by a curve E. The spacing between the wires 27 and the surface 13 is increased in the direction of movement of the surface 13 relative to the apparatus 22 as illustrated in FIG. 3. It will be seen that the initial ion current is high, enabling rapid charging of the surface 13. The ion current is reduced to zero at a low surface potential, thereby reducing leakage current to a negligible value. This enables the surface 13 to be rapidly charged to the desired potential and positively prevents overcharging. A phantom line curve D illustrates an ideal case in which the ion current is maintained at a high value until the desired surface potential is reached, at which point the ion current drops sharply to zero.

As a practical example, the surface 13 is moved rightwardly relative to the apparatus 22 at a speed of 125 cm/sec. A length L1 of the apparatus 22 is equal to 28 mm. The minimum spacing between the wires 27 and the surface 13 is designated as H1 and is between 1.5 mm and 2 mm. The spacing L2 between the wires 27 in the plane 28 is between 1.5 mm to 3 mm and is constant. A maximum spacing H2 between the wires 27 and the surface 13 between 3 mm and 5 mm.

Figure 4:
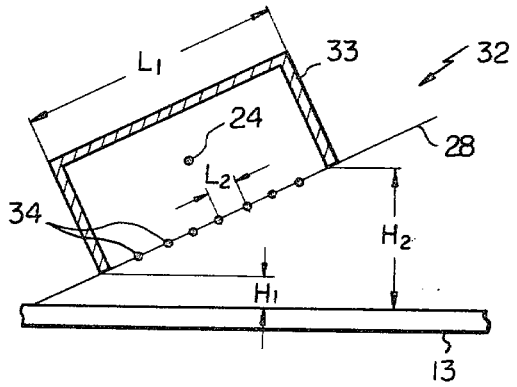
FIG. 4 is a simplified diagram of a second embodiment of a scorotron charger embodying the present invention.

In the apparatus 22, the housing 23 is mounted parallel to the surface 13 and the wires 27 are oriented in the plane 28 which is inclined relative to the housing 23. In an apparatus 32 illustrated in FIG. 4, wires 34 are also oriented in the plane 28. However, a housing 33 is oriented parallel to the plane 18 rather than to the surface 13. In other words, the wires 34 are mounted parallel to the housing 33 and the entire apparatus 32 is oriented in an inclined relation to the surface 13. The apparatus 32 is advantageous in that it allows easy adjustment of the spacing and angle between the wires 34 and surface 13 during manufacture and maintenance.

Figure 9:
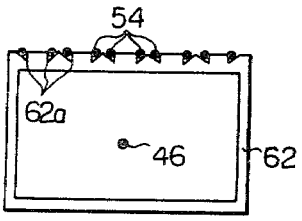
FIG. 9 is a section taken on a line IX—IX of FIG. 7.
Figure 7:
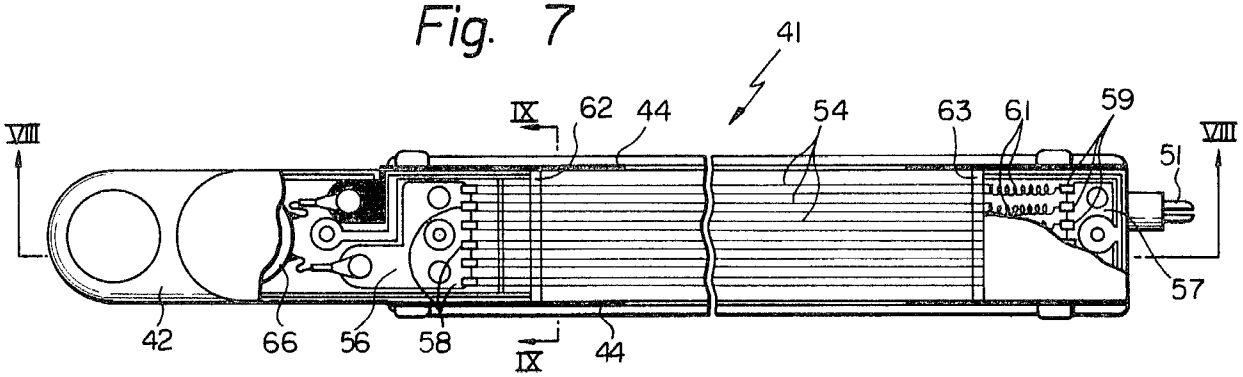
FIG. 7 is a plan view of a practical scorotron charger embodying the present invention as seen from a surface to be charged.
Figure 8:
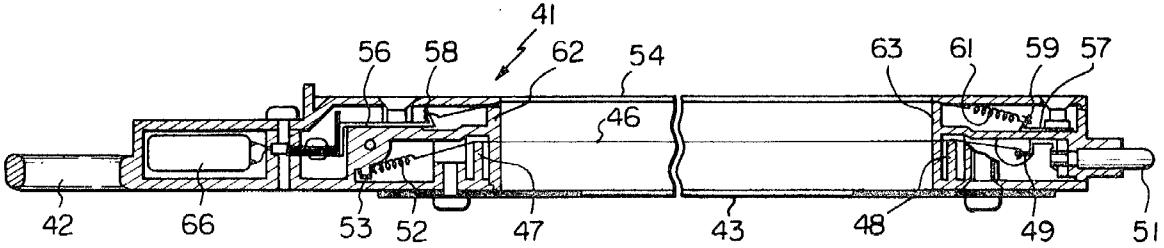
FIG. 8 is a section taken on a line VIII—VIII of FIG. 7.

A practical scorotron charging apparatus embodying the principles of the apparatus 22 is illustrated in FIGS. 7 to 9 and designated as 41. In FIG. 7, the apparatus 41 is viewed from the surface which is to be charged. In FIG. 8, the surface which is to be charged is oriented above the apparatus 41, although not shown.

The apparatus 41 comprises an electrically conductive housing 42 which constitutes a shield. The housing 42 is formed with a back plate 43 and two side plates 44 which are electrically interconnected to each other and to ground. A corona charging electrode in the form of a wire is designated as 46 and extends between the edges of upstanding plates 47 and 48 at the left and right end portions of the housing 42 respectively. The right end of the electrode 46 is formed into a loop which is retained by a lug 49. The lug 49 is electrically connected to a connector 51 for connection to a high voltage source (not shown).

The left end of the electrode 46 is also formed into a loop and is connected thereby to one end of a tension spring 52. The other end of the spring 52 is connected to a lug 53. Thus, the electrode 46 is stretched between the plates 47 and 48 by the spring 52. All components which contact the electrode 46, lug 49 and connector 51 are made of electrically insulative materials so that the electrode 46 is insulated from the electrically grounded components of the housing 42.

The apparatus 41 further comprises electrically conductive wires 54 which are provided in the form of elongated loops. A retainer plate 56 and a retainer plate 57 are fixedly mounted at the left and right end portions of the housing 42 but electrically insulated from the grounded portions thereof. The plate 56 is formed with a plurality of bent back tabs or lugs 58 around which the left ends of the wires 54 are respectively looped. The retainer plate 57 is formed with similar lugs 59. Tension springs 61 are connected at their opposite ends to the right ends of the wires 54 and the lugs 59 respectively. Upstanding, electrically insulative plates 62 and 63 are provided adjacent to the retainer plates 56 and 57 respectively. The wires 54 are stretched over the upper ends of the plates 62 and 63 by the springs 61 respectively. The upper edges of the plates 62 and 63 are formed with recesses for spacing the wires 54 from each other by the required distances. The plate 62 is illustrated in FIG. 9 with the recesses being designated as 62*a*. In this manner, the wires 54 are supported by the housing 42 but electrically insulated from the grounded portions thereof.

A zener diode 66 is connected between the grounded side plate 44 and the retainer plate 56 and thereby between the wires 54 and ground. The connection polarity of the zener diode 66 is selected in accordance with the polarity of the power source. The apparatus 41 is mounted at a suitable distance and angle of inclination relative to the surface to be charged.

In summary, it will be seen that the present invention provides a scorotron corona charging apparatus which overcomes the drawbacks of the prior art and enables a charge of a predetermined potential to be applied to a surface quickly and efficiently. Various modifications will become possible for those skilled in the art after receiving the teachings of the present disclosure without departing from the scope thereof. For example, the wires 27, 34 and 54 may be adapted to be spaced from each other by a predetermined distance on a curved, rather than a straight line. The present apparatus may be further adapted to operate in an electrostatic copying machine in which charging and exposure to a light image are performed simultaneously.

What is claimed is:

1. A corona charging apparatus for applying an electrostatic charge to a surface which is moved relative to the apparatus including a corona discharge electrode, characterized by comprising:

a plurality of parallel wires disposed between the electrode and the surface and extending perpendicular to a direction of movement of the surface relative to the apparatus, a spacing between the wires and the surface progressively increasing in said direction of movement.

2. An apparatus as in claim 1, in which the wires are equally spaced from each other in a plane which is inclined relative to the surface.

3. An apparatus as in claim 1, further comprising power source means for applying a high voltage to the electrode and a low voltage to the wires.

4. An apparatus as in claim 1, further comprising a housing having an open end facing the surface, the electrode and wires being disposed in the housing.

5. An apparatus as in claim 4, in which the housing is mounted parallel to the surface, the wires being equally spaced from each other in a plane which is inclined relative to the housing.

6. An apparatus as in claim 4, in which the wires are equally spaced from each other in a plane which is parallel to the housing, the housing being inclined relative to the surface.

7. A corona charging apparatus for applying an electrostatic charge to a surface which is moved relative to the apparatus including a corona discharge electrode, characterized by comprising:

a plurality of parallel wires disposed between the electrode and the surface, a spacing between the wires and the surface progressively increasing in a direction of movement of the surface relative to the apparatus; and a power source, the electrode being connected to a high voltage end of the power source, and a zener diode connected between the wires and a low voltage end of the power source.

* * * * *